United States Patent [19]

Baus

[11] Patent Number: 4,897,889

[45] Date of Patent: Feb. 6, 1990

[54] SHOWER-PARTITION WITH PIVOTED DOOR

[75] Inventor: Heinz G. Baus, Hünibach-Thun, Switzerland

[73] Assignee: Altura Leiden Holding B.V., Maastricht, Netherlands

[21] Appl. No.: 156,737

[22] Filed: Feb. 18, 1988

[30] Foreign Application Priority Data

Feb. 20, 1987 [DE] Fed. Rep. of Germany ..... 3705433

[51] Int. Cl.[4] ..... E06B 1/30; A47K 17/00

[52] U.S. Cl. ..... 4/607; 4/610; 49/383; 49/505; 52/217; 160/210

[58] Field of Search ..... 4/555, 556, 557, 558, 4/596, 600, 607, 608, 609, 610, 611, 644; 16/86.1, 87 R, 94 R, 95 R, 96 R, 103–105; 49/381, 383, 384, 397, 505; 52/212, 213, 217, 716, 717.1, 718.1; 160/117, 199, 210, 213; 403/3, 4, 7

[56] References Cited

U.S. PATENT DOCUMENTS

| | | | |
|---|---|---|---|
| 1,614,318 | 1/1927 | Ricken . | |
| 2,595,506 | 5/1952 | Backman | 16/94 R |
| 2,767,423 | 10/1956 | Gang et al. | 16/94 R |
| 2,911,654 | 11/1959 | Bruno | 4/607 |
| 3,111,208 | 11/1963 | Grossman | 4/607 |
| 4,118,810 | 10/1978 | Brickhouse et al. | 4/556 |
| 4,228,560 | 10/1980 | Baus | 4/557 |
| 4,453,346 | 6/1984 | Powell et al. . | |
| 4,520,608 | 6/1985 | Baus | 4/610 |
| 4,606,084 | 8/1986 | Baus | 4/610 |
| 4,611,436 | 9/1986 | Williams | 4/557 |
| 4,611,947 | 9/1986 | Baus | 52/217 |

FOREIGN PATENT DOCUMENTS

| | | | |
|---|---|---|---|
| 118883 | 9/1984 | European Pat. Off. . | |
| 1709441 | 6/1974 | Fed. Rep. of Germany . | |
| 2513172 | 10/1975 | Fed. Rep. of Germany . | |
| 3433135 | 2/1986 | Fed. Rep. of Germany . | |
| 2262949 | 9/1975 | France | 4/557 |
| 1093342 | 11/1967 | United Kingdom . | |
| 1482372 | 8/1977 | United Kingdom . | |
| 2120713 | 12/1983 | United Kingdom . | |

*Primary Examiner*—Philip R. Coe
*Assistant Examiner*—Joseph S. Machuga
*Attorney, Agent, or Firm*—Foley & Lardner, Schwartz, Jeffery, Schwaab, Mack, Blumenthal & Evans

[57] ABSTRACT

A shower-partition contains a pivoted door which is hinged to a compensating section by means of hinges. The compensating section is secured, in such a manner as to be horizontally adjustable, to a second profiled rail by means of connecting elements. It is proposed to make it possible to align the pivoted door both horizontally and vertically in a simple manner, with little increase in production costs. The compensating section shall comprise an open longitudinal groove which faces the pivoted door and comprises an undercut for attachment of the hinge-holders. The compensating section is adapted to be aligned vertically, jointly with the pivoted door, in relation to the second profiled rail, the compensating section and/or the holder of the lower hinge being mounted upon the floor or the upper edge of a shower-tub.

20 Claims, 5 Drawing Sheets

SHOWER-PARTITION WITH PIVOTED DOOR

BACKGROUND OF THE INVENTION

1. Field of the Invention

The present invention relates to a shower-partition comprising a pivoted door.

2. Description of the Prior Art

Known from U.S. Pat. No. 1,614,318 is an arrangement for the attachment of a pivoted door, the hinge of which comprises a hinge-holder connected to a profiled rail. The other hinge-part is connected to the pivoted door. Arranged stationarily is a second profiled rail, in relation to which the first-mentioned profiled rail is adjustable in the horizontal direction only. Located in a cavity, for the purpose of connecting the two profiled rails, is a U-shaped clip which, on the one hand, is secured against rotation in relation to an adjusting screw passing through the first profiled rail and, on the other hand, is adapted to rotate in relation to a screw secured to the second profiled rail. The position of the pivoted door in relation to the stationary profiled rail cannot be altered in the vertical direction, i.e. along the hinge-axis. Production tolerances, or assembly inaccuracies may lead to excessive or insufficient clearances between the lower edge of the door and the floor, and there is no compensation for this.

European Pat. No. 118 883 discloses a shower-partition having a pivoted door, in which the hinge-holder consists of two parts which can be adjusted horizontally in relation to each other. One of the parts is associated with the pivoted door and contains the pin or axis of the hinge, while the other part is connected to the stationary profiled rail. Two such hinges are provided and a cover-section is arranged between the vertically spaced first parts of the hinge-holder. It is not easy to align the door vertically since, in order to adjust the lower hinge, the two parts of the hinge-holder must be released from the upper hinge and, furthermore, the cover-section must be removed. The latter does not carry or support the hinge in any way.

German Pat. No. 34 33 135 discloses a shower-partition, the hinge-holder of which is arranged upon a stationary profiled rail. The hinge-part, connected to the pivoted door, exhibits, in a horizontal arm, an elongated hole to permit adjustment of the door in relation to the profiled rail in the horizontal direction. As seen in the direction towards the shower-tub, the door is arranged behind the vertical axis of rotation and, for purpose of adjustment, the front edge thereof, on the hinge-side, may be pushed behind the first profiled rail. The latter must be relatively wide to match the dimensions of the adjustment area. This is a disadvantage since it restricts the width of the passage through which the user must pass.

OBJECTS OF THE INVENTION

It is an object of the invention to develop a shower-partition of the above type, at little structural cost, in order to provide satisfactory adjustment in the horizontal direction at right angles to the axis of rotation and in the vertical direction. Furthermore, simple assembly and handling should be assured. It should be possible to assemble the partition rapidly and safely, and costly measures, such as the cutting of profiled rails, the use of expensive tools, etc. should be avoided. The partition should ensure functional and reliable sealing of the entrance. It should be possible to effect assembly and adjustment of the door rapidly, with the necessary accuracy, even if on-site tolerances are large. It should be possible to fit the partition, with few components, to shower-tubs of varying widths and costly storage and production of wide profiled rails and other accessories is to be eliminated.

In known shower-partitions, difficulties may arise if the wall of the room, and the profiled rail secured thereto, are not exactly vertical. In such a case, vertical alignment of the axis of rotation is impossible and this has a detrimental effect upon the smooth operation of the door and upon the seal.

SUMMARY OF THE INVENTION

According to the present invention, there is provided a shower-partition comprising a pivoted door, with a first profiled rail which is in the form of a compensating rail and to which the pivoted door is hinged by at least two hinges, one upper and one lower, having substantially vertical axes of rotation and each comprising at least one hinge-mount connected to said compensating section; and with a stationary profiled rail, in relation to which the compensating rail is adapted to be aligned horizontally and in which at least two connecting elements, spaced apart vertically, are arranged, at least one adjusting screw, connected to the compensating rail, being engaged with each connecting element by means of a thread, wherein:

the compensating rail contains an open longitudinal groove facing the pivoted door and comprising an undercut;

the hinge-mounts each have a base which is arranged in said longitudinal groove and is secured therein;

said compensating rail is adapted to be aligned vertically, jointly with the pivoted door, in relation to the stationary profiled rail.

Preferably, there are two hinge-mounts for each hinge so that each hinge comprises a lower hinge-mount and an upper hinge-mount, the lower hinge-mount of the lower hinge having a bottom surface which is supported, directly or indirectly, by means of a spacer, upon an edge or the bottom of the shower-tub.

The proposed shower-partition is of a functional and inexpensive design and the adjustment of the pivoted door at right angles to the axis of rotation, and also vertical alignment of the said axis of rotation, may be carried out without difficulty. Reliable sealing of the entrance is assured. The pivoted door, the compensating section, and the hinge may all be prefabricated at the factory. All that is then needed to install the partition in a bathroom is to screw the adjusting screws into the connecting elements which are secured, together with the first profiled rail to one wall of the room or to a corner-post. It is desirable for the compensating section, and/or the holder of the lower hinge, to have its undersurface resting, if necessary through a distance-piece, upon the edge of the shower-tub or upon the floor if there is no shower-tub. The hinge-holder which, according to the invention, is secured to the compensating section, may also be displaced horizontally and adjusted therewith. Vertical alignment merely requires that the adjusting screws which, like the connecting elements, are spaced vertically apart, be screwed accordingly into the connecting elements.

Preferably, located in the vicinity of the free vertical longitudinal edge, remote from the hinges, of the pivoted door, is a stop-section on an additional stationarily arranged profiled rail comprising at least one sealing lip and/or resilient sealing element. The stop-section may carry a seal associated with the front side, in order to ensure functional and reliable sealing of the longitudinal edge of the door. Also arranged upon the longitudinal edge, on the hinge-side, of the compensating section may be a seal which also bears against the front side of the door when it is in the closed condition.

Preferably, at least the holder of the lower hinge exhibits a sloping surface upon which the hinge-part connected to the pivoted door is adapted to move vertically upwardly when the door is swung open. Dragging of the seal provided on the lower edge of the door, or even of the door itself, upon the floor or the shower-tub is definitely avoided.

BRIEF DESCRIPTION OF THE DRAWING

Preferred embodiments will now be explained as non-limiting examples, having reference the attached drawings, wherein.

DESCRIPTION OF PREFERRED EMBODIMENT

Figure 1:
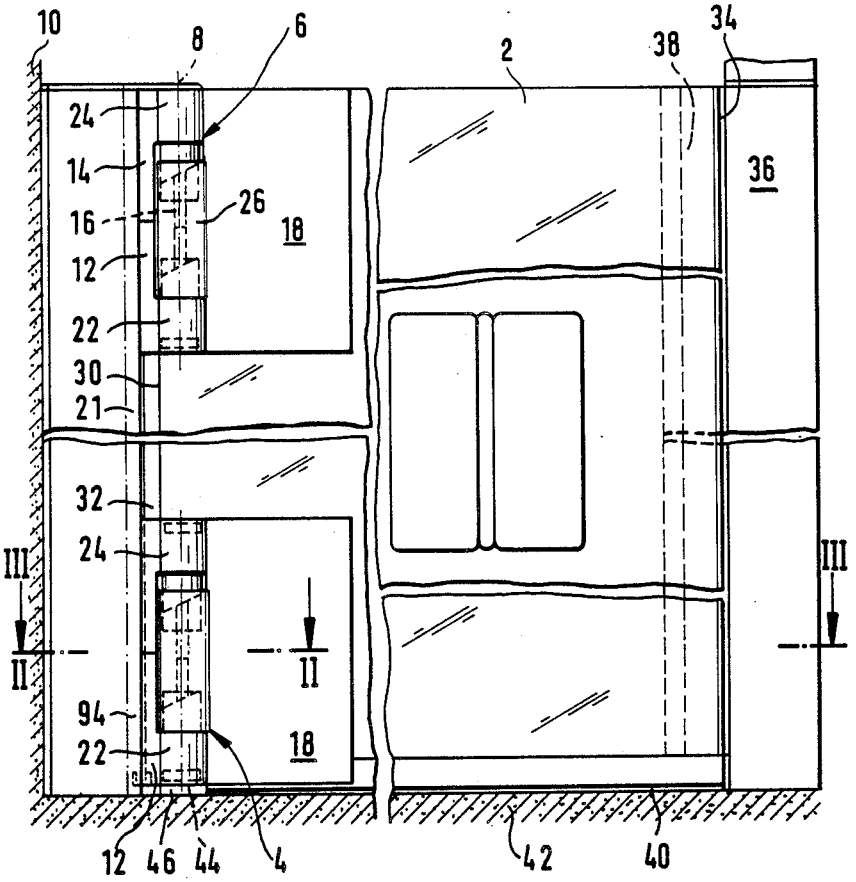
FIG. 1 is a diagrammatical view of the shower-partition.

FIG. 1 is a view of the shower-partition with a door 2 which is arranged to pivot, by means of a lower hinge 4 and an upper hinge 6, about a vertical axis 8 in relation to the wall 10 of a room. Each hinge has two hinge-mounts 12,14, pins 16 of which engage in corresponding holes in hinge-parts 18 connected to the door by means of screws. The hinges and mounts are secured in an undercut 21 in a profiled compensating rail 20. Arms 22,24 of hinge-mounts 12,14 engage a central part 26 of hinge-part 18. During assembly, the two hinge-mounts 12,14 may be displaced vertically in relation to each other and they are connected to compensating rail 20 by means of screws. The compensating rail 20 is adjustable horizontally in relation to a stationary profiled rail 28. To this end, at least two vertically spaced connecting elements 48 are provided in the interior. Furthermore, a seal 32 is arranged on the compensating rail 20 adjacent the front edge 30 of the door, on the hinge-side.

Located on the front edge 34, remote from the hinges 4,6, of the door 2, is an additional profiled rail 36 containing a stop-section 38. Like stationary profiled rail 28, this additional profiled rail 36 may be secured to the wall of a room, or it may also be extended beyond the upper edge of the door to be secured to the ceiling of the room. In the latter case, a stationary wall element is located behind the plane of FIG. 1. Like door 2, this may be made of glass or plastic. Located at the bottom of the door 2 is a sealing section 40 co-operating with the edge of a shower-tub 42. The bottom surface 44 of the lower hinge-mount 12 of lower hinge 4 rests, either directly, or indirectly through a space 46, upon the edge of the shower-tub 42. The distance between the lower edge of the door 2 and the shower-tub 42 may be adjusted by means of the spacer 46. The compensating rail 20 may be mounted vertically upon the floor or upon the edge of the tub 42.

Figure 2:
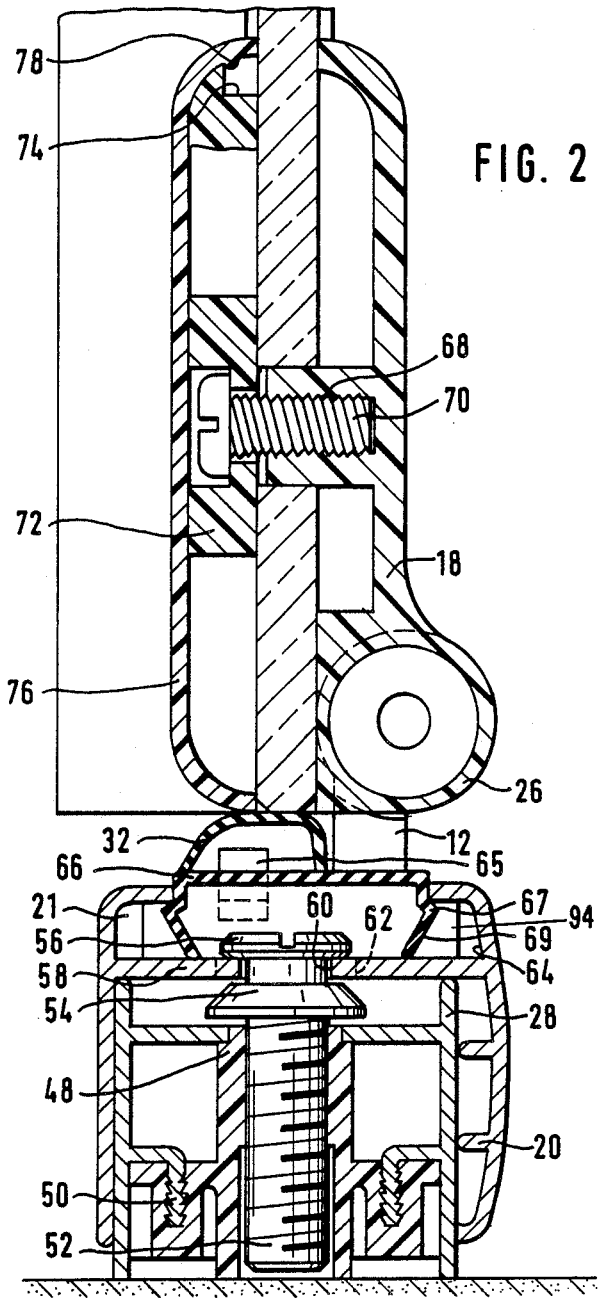
FIG. 2 is a cross-section view along line II—II of FIG. 1.

FIG. 2 shows, to an enlarged scale, a cross-section along the line II—II of FIG. 1. A connecting element 48, secured to the stationary profiled rail 28, may be seen quite clearly. To this end, the stationary profiled rail 28 comprises hook-shaped extensions 50 engaging in recesses provided in the connecting element 48. The extensions 50 have serrated outer surfaces ensuring satisfactory anchorage and are bent towards the wall of the room. During assembly, the connecting elements are simply pressed, from this side, into the stationary profiled rail 28 and this requires no screwing or similar fastening operations. The connecting element 48 contains an internal thread into which an adjusting screw 52 is screwed. The latter is equipped with a shoulder 54 spaced from a head 56. The compensating rail 20 carries, in a partition 58, an elongated hole 60 through which said adjusting screw 52 extends so that the partition is positioned between the shoulder 54 and the head 56 of the adjusting screw 52. Adjoining hole 60 in the vertically downward direction, in this case behind the plane of the drawing, is an enlarged opening 62, indicated by dotted lines, through which head 56 may be passed.

During assembly, the stationary profiled rail 28 is first secured, by means of screws (not explained further at this time), after which the compensating rail 20 is placed upon the stationary profiled rail 28 in such a manner that head 56 of the screw 52 passes through the enlarged opening 62. The compensating rail 20 is thereafter pushed vertically downwards, and the distance between the compensation rail and the wall of the room may be adjusted by turning the adjusting screw 52. The vertical adjustment may be carried out by means of the spacer 46 mentioned above, the height of the spacer 46 being set to the distance required between the lower edge of the door and the edge of the tub or the floor. Door 2, together with the hinge and the compensating rail 20 are preassembled at the factory or are so made as to be rapidly assembled. Since there are two vertically spaced connecting elements 48, preferably in the vicinity of the hinges, exact vertical alignment of the compensating section 20 is easily carried out by positioning adjusting screws 52 in elongated holes 60.

The hinge-mounts 12 and 14, are both secured in an undercut longitudinal groove 64 in the compensating rail 20, more particularly by means of screws. The longitudinal groove 64, open towards the door 2 and having an undercut 21, is closed by means of a cover-section 66, in which the seal 32 is secured with a part 65. According to the invention, the seal 32 may also be a part of cover section 66. As may be gathered from the drawing, resilient seal 32 is compressed by the front edge 30 of door 2. This produces a reliable seal, and production tolerances in the vicinity of the hinges, and/or the attachment of the door, may be reliably compensated for. The seal 32 extends over the entire vertical height of the door and behind the hinge-holders, and there is therefore no break in the seal, even in the vicinity of the hinges. The vertical axis of rotation 8 lies in front of the vertical plane of the door when the latter is in the closed condition, whereas shower-tub 42 is located behind door 2. In contrast to this, cover section 66 comprises openings. The bases of the hinge-mounts 12,14 and the cover-section 66 are arranged in the same undercut longitudinal groove 64 in compensating rail 20. The cover-section 66 is made of a resilient plastic in such a manner that legs 69, equipped with locking catches 67, engage behind the opening in the longitudinal groove 64 associated with the door 2. Seal 32 may be secured to front edge 30 of the door 2 as an alternative.

The hinge-part 18 contains a stud 68 which passes through a hole in the door 2. Located in front of the plane of FIG. 2 is another matching stud. Screwed into stud 68 from the other side is a screw 70, the head of which rests upon a baseplate 72. The baseplate 72 ensures uniform distribution of stress and prevents damage to the door. It is approximately cruciform in shape and contains an outer undercut groove 74 in which a hinge-cover 76 engages with a projection 78.

Figure 3:
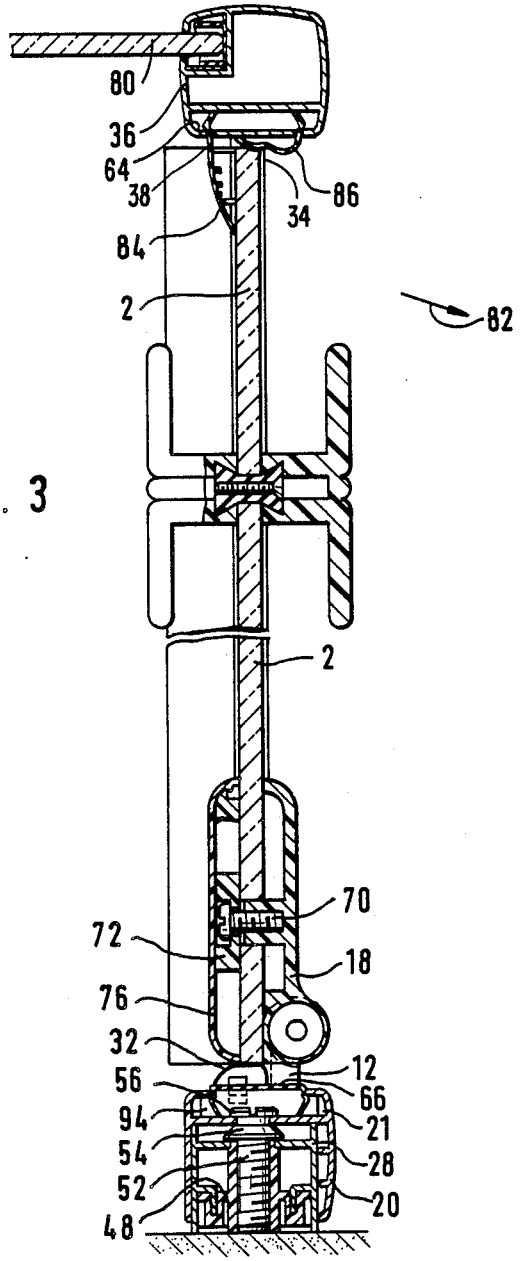
FIG. 3 is a cross-section view along line III—III of FIG. 1.

FIG. 3 shows, to an enlarged scale, a cross-section along the line III in FIG. 1. The additional profiled rail 36 and the other front edge 34 of door 2 remote from the hinges 4, 6, may be seen quite clearly. Also seen is a part of a wall element 80 which is secured to the profiled rail 36. The door 2 may be pivoted open in the direction of arrow 82. The stop-section 38 is anchored in the undercut longitudinal groove 64 in the profiled rail 36 by means of legs and locking catches, in the same way as above mentioned cover-section. There is no change in the distance between the stop-section 38 and the front edge 34. A reliable sealing is assured. The stop-section 38 carries a sealing lip 84 on the shower-tub side and a resilient seal 86 which bears tightly against the front edge 34. As a result of this configuration, a double sealing is assured at a low structural cost. Like the seal 32 on the hinge-side of the cover-section, the seal 86 is in the form of a hollow section which may be compressed by, the front edge 34 of door 2 towards profiled the rail 36.

Figure 5:
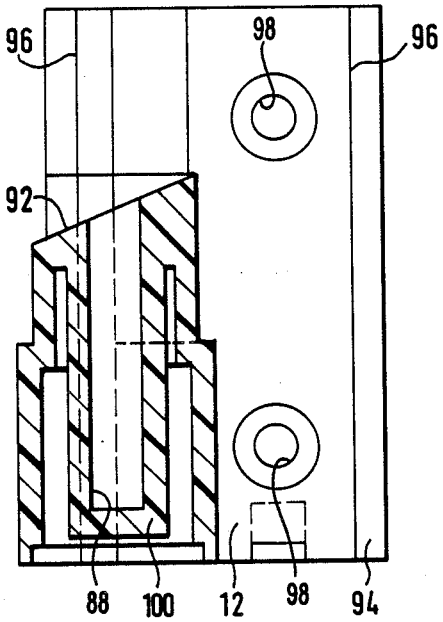
FIG. 5 is a cross-section view along line V—V of FIG. 4.
Figure 4:
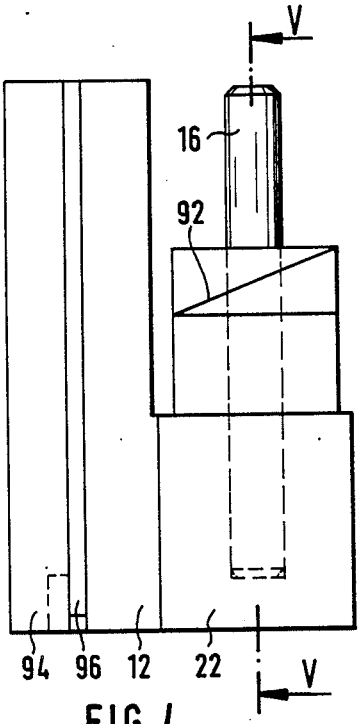
FIG. 4 is a view of the lower hinge-holder as seen from the same direction as in FIG. 1.

FIGS. 4 and 5 show a plan view and a cross-section of the hinge-mount 12 having an arm 22 comprising an opening 98, closed off at the bottom to form a blind hole, for receiving a pin 16. The top of the arm 22 has a sloping surface 92 which co-operates with a corresponding sloping surface 102 on the hinge-part 18 secured to the door, so that when the latter is pivoted open, it moves vertically upwardly. The hinge-mount 12 comprises a base 94 engaging in the undercut longitudinal groove 64 in the compensating rail 20. Lateral surfaces 96 serve for axial alignment of the hinge-mount 12, with the guide-surfaces in the opening in the longitudinal groove. Screws are passed through holes 98 in order to secure the hinge-mount to the partition 58 in the compensating rail 20. As may be seen in FIG. 5, opening 88 is located in a pot-shaped part 100 which is connected at the top to the remainder of the hinge-holder. As a result of the receipt of pins 16 in openings 88 and in central part 26 of the hinge-part 18, errors in alignment of the four hinge-holders can easily be compensated for.

Figure 6:
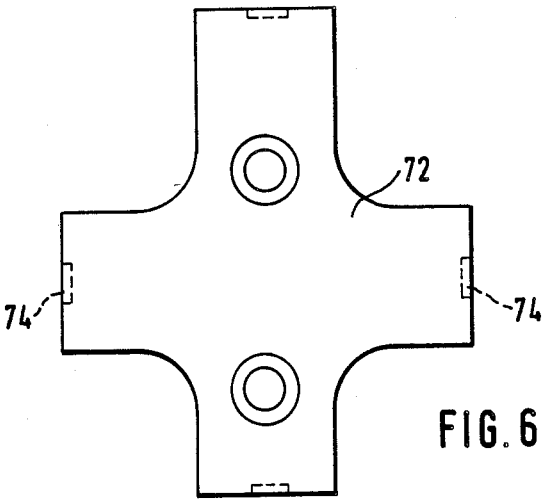
FIG. 6 is a view of the baseplate as seen in direction VI in FIG. 2.

FIG. 6 shows cruciform base plate 72 for screws 70 explained in conjunction with FIG. 2. This cruciform design ensures satisfactory stress-distribution, thus eliminating damage to the door which is preferably made of glass. Also recognizable is a groove 74, located behind the plane of the drawing, into which the projections 78 from the hinge-cover 76 are snapped.

Figure 7:
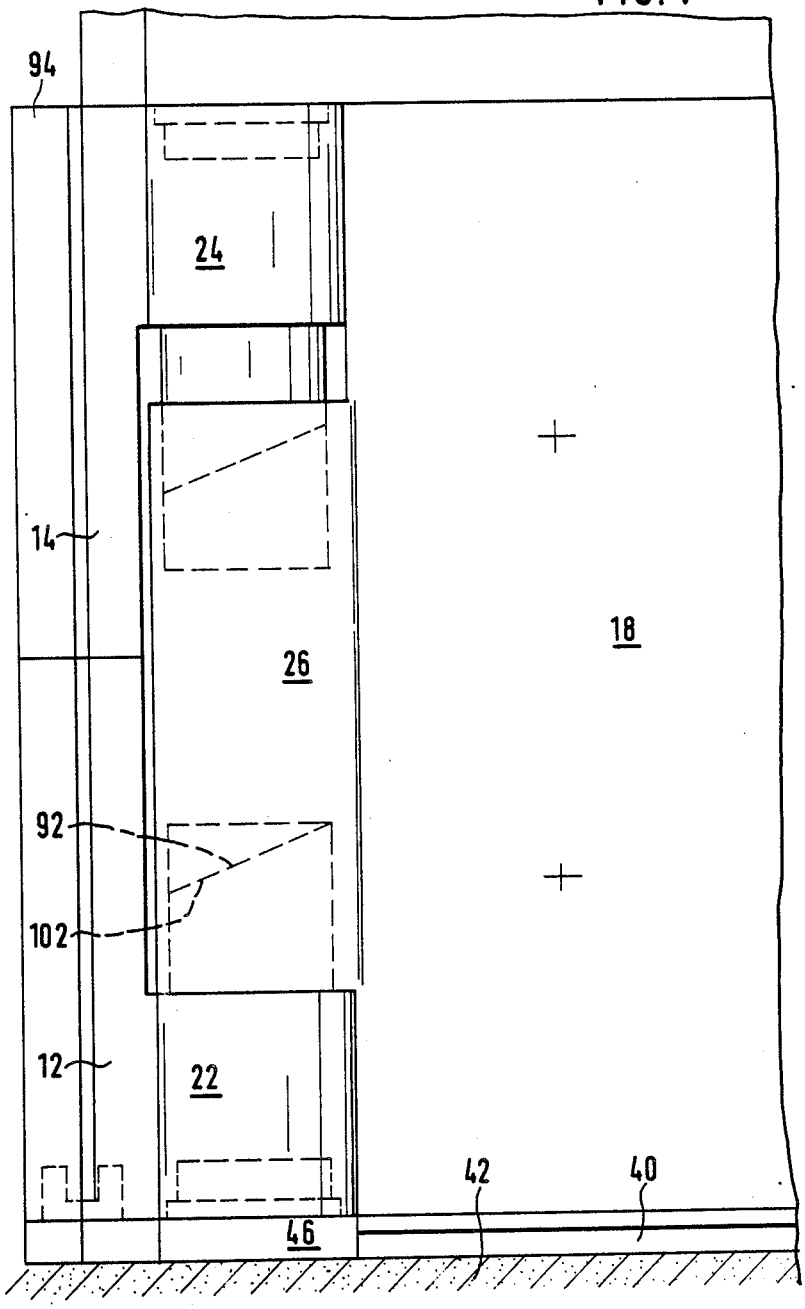
FIG. 7 is a view, to an enlarged scale, of the lower hinge according to FIG. 1.

FIG. 7 shows, to an enlarged scale, the lower hinge with its two mounts 12 and 14 which are pushed into the undercut groove 64 in compensating rail 20. The spacer 46, between the edge of the shower-tub and lower hinge-holder 12 is visible. The hinge-part 18 engages between arms 22 and 24. The hinge-part 18 contains at least one sloping surface 102 oriented toward lower holder 12 and co-operating with sloping surface 92 of hinge-holder 12. Upper hinge-holder 14 is designed with a similar sloping surface. It will be gathered that the hinge is fitted to the left of the door as seen when looking towards the shower-tub. The door may, of course, also be fitted to the right, in which case hinge-holder 14, shown here at the top, will be arranged at the bottom above the edge of the tub and the sloping surface now serves to lift the door fitted to the right. It is advantageous according to the invention that for each hinge two hinge-holders 12,14 be provided, each of them containing a pin, so that the hinge-part 18 cannot be lifted out. During assembly, hinge-mounts 12,14 are moved towards each other in the undercut longitudinal groove, and the pins engage from opposite directions, e.g. from above and below, in corresponding holes in hinge-part 18.

I claim:

1. A shower-partition comprising:

a door having a hinge edge and a free edge, a stationary profiled rail;

a profiled compensating rail arranged on said stationary rail, said compensating rail comprising a partition forming the base of a longitudinal undercut groove open toward said hinge edge of said door;

at least two hinges having substantially aligned axes of rotation, each hinge comprising at least one hinge-mount having a base portion received in said undercut groove and secured to said compensating rail, said hinges pivotably mounting said door on said compensating rail; and means for horizontally and vertically adjusting the position of said compensating rail and pivotably mounted door relative to said stationary rail comprising at least two connecting elements mounted in longitudinally spaced positions on said stationary rail and at least two adjusting screws with heads axially secured in longitudinally elongated slots in said compensating rail and threaded portions each received in a threaded hole in a respective one of said connecting elements.

2. A shower-partition according to claim 1, wherein each hinge comprises two hinge-mounts.

3. A shower-partition according to claim 1, wherein said elongated slots are formed in said partition, and an enlarged opening is provided adjacent each elongated slot through which the head of one of said adjusting screws may pass after which said screw can be displaced along said elongated slot with said partition received between the head of said screw and a shoulder on said screw to axially secure said screw relative to said compensating rail.

4. A shower partition according to claim 1, wherein said base portions of the hinge-mounts and the heads of the adjusting screws are all arranged in said longitudinal undercut groove of said compensating rail.

5. A shower-partition comprising:

a door having a hinge edge and a free edge, a stationary profiled rail;

a profiled compensating rail arranged on said stationary rail, said compensating rail defining a longitudinal undercut groove facing said hinge edge of said door;

at least two hinges having substantially aligned axes of rotation, each hinge comprising at least one hinge-mount having a base portion received in said undercut groove and secured to said compensating rail, said hinges pivotably mounting said door on said compensating rail; and means for horizontally and vertically adjusting the position of said compensating rail and pivotably mounted door relative to said stationary rail comprising at least two connecting elements mounted in longitudinally spaced positions on said stationary rail and at least two adjusting screws with heads axially secured in longitudinally elongated slots in said compensating rail and threaded portions each received in a threaded hole in a respective one of said connecting elements;

wherein each hinge comprises two hinge-mounts; said compensating rail comprises a partition forming the base of said undercut groove; said elongated slots are formed in said partition; enlarged opening is provided adjacent each elongated slot through which the head of one of said adjusting screws may pass after which said screw can be displaced along said elongated slot with said partition received between the head of said screw and a shoulder on said screw to axially secure said screw relative to said compensating rail; and a cover-section is arranged in said longitudinal groove of said compensating rail, said cover-section being provided with a flexible seal which bears against said hinge edge of said door when said door is closed.

6. A shower-partition according to claim 5, further comprising an additional profiled rail arranged adjacent said free edge of said door when said door is closed, said additional profiled rail defining a longitudinal groove facing said free edge of said door when said door is closed, and a stop-section secured in said longitudinal groove of said additional profiled rail.

7. A shower-partition according to claim 6, wherein said stop-section comprises a sealing lip extending toward said door and carries a resilient seal which bears against said free edge of said door when said door is closed.

8. A shower-partition according to claim 7, wherein the seal of the cover-section and the seal of the stop-section are resiliently flexible hollow members which are compressed by the hinge and free edges of said door, respectively, when said door is closed.

9. A shower-partition comprising:

a door having a hinge edge and a free edge, a stationary profiled rail;

a profiled compensating rail arranged on said stationary rail, said compensating rail defining a longitudinal undercut groove facing said hinge edge of said door;

at least two hinges having substantially aligned axes of rotation, each hinge comprising at least one hinge-mount having a base portion received in said undercut groove and secured to said compensating rail, said hinges pivotably mounting said door on said compensating rail; and means for horizontally and vertically adjusting the position of said compensating rail and pivotably mounted door relative to said stationary rail comprising at least two connecting elements mounted in longitudinally spaced positions on said stationary rail and at least two adjusting screws with heads axially secured in longitudinally elongated slots in said compensating rail and threaded portions each received in a threaded hole in a respective one of said connecting elements;

wherein each hinge comprises a lower hinge mount and an upper hinge mount, said lower hinge-mount of a lower hinge having a bottom surface which is supported by a spacer on an upper edge of an underlying shower-tub.

10. A shower-partition according to claim 9, wherein the lower hinge-mount and the upper hinge-mount of each hinge each comprise an arm which carries a vertical pin, and said pins are received from opposite directions in corresponding holes in a hinge-part connected to the door.

11. A shower-partition according to claim 9, wherein said bottom surface of said lower hinge-mount is displaceable horizontally, jointly with said compensating rail.

12. A shower-partition according to claim 9, wherein said compensating rail is vertically adjusted by means of said spacer.

13. A shower-partition according to claim 12, wherein said compensating rail and the lower hinge-mount of said lower hinge are adjusted vertically by means of said spacer.

14. A shower-partition according to claim 13, wherein each of said hinge-mounts is provided with a hinge pin, said hinge-mounts being adapted to move toward each other in said undercut longitudinal groove, and said pins engage from opposite directions in corresponding holes in said hinge-parts, so that each hinge-part is prevented from being lifted out of said hinge-mounts.

15. A shower-partition comprising:

a door having a hinge edge and a free edge, a stationary profiled rail;

a profiled compensating rail arranged on said stationary rail, said compensating rail defining a longitudinal undercut groove facing said hinge edge of said door;

at least two hinges having substantially aligned axes of rotation, each hinge comprising at least one hinge-mount having a base portion received in said undercut groove and secured to said compensating rail, said hinges pivotably mounting said door on said compensating rail; and means for horizontally and vertically adjusting the position of said compensating rail and pivotably mounted door relative to said stationary rail comprising at least two connecting elements mounted in longitudinally spaced positions on said stationary rail and at least two adjusting screws with heads axially secured in longitudinally elongated slots in said compensating rail and threaded portions each received in a threaded hole in a respective one of said connecting elements;

wherein a seal is arranged on said compensating rail so as to sealingly contact said hinge edge of said door when said door is closed.

16. A shower-partition according to claim 15, further comprising an additional profiled rail for attachment to a wall or ceiling of a room, said additional profiled rail being arranged adjacent said free edge of said door when said door is closed and carrying a stop-section which engages said free edge of said door when said door is closed.

17. A shower-partition according to claim 16, wherein said connecting elements are mounted on said stationary profiled rail by means of hook-shaped extensions with serrated outer surfaces formed on said stationary profiled rail, said extensions pressingly engaging in recesses provided in said connecting elements.

18. A shower-partition comprising:

a door having a hinge edge and a free edge, a stationary profiled rail;

a profiled compensating rail arranged on said stationary rail, said compensating rail defining a longitudinal undercut groove facing said hinge edge of said door;

at least two hinges having substantially aligned axes of rotation, each hinge comprising at least one hinge-mount having a base portion received in said undercut groove and secured to said compensating rail, said hinges pivotably mounting said door on said compensating rail; and means for horizontally and vertically adjusting the position of said compensating rail and pivotably mounted door relative to said stationary rail comprising at least two connecting elements mounted in longitudinally spaced positions on said stationary rail and at least two adjusting screws with heads axially secured in longitudinally elongated slots in said compensating rail and threaded portions each received in a threaded hole in a respective one of said connecting elements;

wherein each hinge comprises two hinge-mounts which are displaceable relative to each other in said longitudinal undercut groove, each of said hinge-mounts comprising an arm which carries a hinge pin, and said hinge pins are received from opposite directions in holes in a T-shaped hinge-part connected to the door.

19. A shower-partition according to claim 18, wherein at least one lower hinge-mount comprises a first sloping surface at the upper end of its arm, and said hinge-part is provided with a cooperating second sloping surface, whereby said hinge-part is lifted vertically upwardly on said sloping surface when the door is pivoted open.

20. A shower-partition according to claim 19, wherein each hinge-mount comprises a pot-like part for receiving the hinge pin carried by the hinge-mount arm, and only a part of the total height of said pot-like part is in communication with said arm.

* * * * *